US005876109A

United States Patent [19]

Scalco

[11] Patent Number: 5,876,109

[45] Date of Patent: Mar. 2, 1999

[54] LIGHTED JEWELRY ORNAMENTS

[76] Inventor: Vincent James Scalco, 1535 Robyn Rd., Escondido, Calif. 92025

[21] Appl. No.: 938,241

[22] Filed: Sep. 26, 1997

[51] Int. Cl.[6] ..... F21L 15/08

[52] U.S. Cl. ..... 362/104; 362/226; 362/800; 362/806

[58] Field of Search ..... 362/103, 104, 362/226, 806, 186, 800

[56] References Cited

U.S. PATENT DOCUMENTS

| | | | |
|---|---|---|---|
| 3,624,384 | 11/1971 | Ledingham et al. | 240/6.4 W |
| 3,814,926 | 6/1974 | Frasca | 362/104 |
| 4,459,645 | 7/1984 | Glatter | 362/104 |
| 5,253,149 | 10/1993 | Ostema et al. | 362/104 |
| 5,567,037 | 10/1996 | Ferber | 362/104 |
| 5,653,530 | 8/1997 | Pittman | 362/104 X |

*Primary Examiner*—Stephen Husar
*Attorney, Agent, or Firm*—Jenkens & Golchrist

[57] ABSTRACT

Lighted jewelry ornaments contain a lighting device to be used with a variety of different light-transmissive ornaments for making illuminating earrings, necklaces, bracelets, pendants or decorative ornaments to be hung on clothing apparel, trees or chandeliers etc. They are composed of an ornament housing (23) and a decorative threaded cap battery housing (22) having an attachment device, such as an eyepin (10), as a point of attachment for a hanging support device such as an earring fish hook or necklace. Said battery housing encloses a tapered compression coil spring (12) and a battery (15) that electrically connects to a light-emitting diode or light bulb (3) which is contained within said ornament housing by a threaded plug (6). Adhered to an ornament (1) is one of four said threaded plugs, which encircle said light-emitting diode or light bulb and which screws into said decorative threaded cap. Said ornaments are made of solid or hollow, clear or colored light-transmissive material such as plastic, glass, stone or other decorative material. Said threaded plug is part of an ornament's mold and molding or is adhered to a pre-existing molded ornament. Two of the threaded plugs allow for the replacement of said light-emitting diode or light bulb. Different types and colors of said light-emitting diodes or light bulbs can be used. Enlargement of this invention allows for the use of multiple batteries or different types and sizes of batteries for brighter or longer illumination. Lighted jewelry ornaments light up when said battery housing and said ornament housing are fully threaded together.

34 Claims, 4 Drawing Sheets

LIGHTED JEWELRY ORNAMENTS

BACKGROUND-FIELD OF INVENTION

This invention relates to lighted jewelry ornaments having a decorative threaded cap battery housing containing a battery and a light-transmissive ornament housing containing a threaded plug and a light-emitting diode (LED) or light bulb for use as earrings, pendants or decorative hanging ornaments.

BACKGROUND-PRIOR ART

It is well established through thorough investigation that lighted jewelry such as illuminated earrings, lighted pendants and lighting devices for jewelry have been attempted, designed and patented, each having their own design and uniqueness. It is also evident that these patents have their own limitations. Among the list of limitations are fragility, complexity of design, unattractiveness, inability to market, non-versatile, costly to develop, costly to manufacture different ornamental attachments and limited ornamental adaptability. Among the patents which partake in this art are U.S. Pat. Nos. 5,253,149, 4,459,645, 3,814,926 and 3,624,384. The patent that is most relevant to this new invention is U.S. Pat. No. 3,624,384, patented Nov. 30, 1971. U.S. Pat. No. 3,624,384 has limited adaptability for its selective ornament configurations and specifies only a light bulb for its illumination. It does not specify the use of light-emitting diodes or of adapting solid or hollow pre-existing ornaments to a battery housing or light bulb. It specifies a functional use for only earrings.

OBJECTS AND ADVANTAGES

The present invention represents a step beyond the above-described prior art toward superior, versatile, compact and acceptably decorative, lighted jewelry ornaments. Several objects and advantages of my Lighted Jewelry Ornaments are:

(a) to provide a strong connection between the battery housing and solid or hollow ornaments.

(b) to provide versatile lighted jewelry ornaments, that can be adapted for earrings, pendants, or decorative ornaments to be hung on clothing apparel, bracelets, trees, or chandeliers, by changing the hanging support device.

(c) to provide lighted jewelry ornaments that can have their ornament housings interchanged with different decorative threaded cap battery housings.

(d) to provide elegant attractive lighted jewelry ornaments.

(e) to provide lighted jewelry ornaments with the ability to replace or interchange different types or colored LEDs or light bulbs.

(f) to provide lighted jewelry ornaments that can be manufactured inexpensively.

(g) to provide lighted jewelry ornaments that can be manufactured and assembled with ease using home tools in a home based business operation.

(h) to provide lighted jewelry ornaments with the versatility of being made by adapting pre-existing solid or hollow ornaments without needing to generate costly new molded ornaments.

(I) to provide a more durable lighted jewelry ornament that can be swirled in the air by a chain or string.

(j) to provide a bright illuminated ornament.

(k) to provide a simple design for turning the light on and off.

DRAWING FIGURES

In the drawings, closely related figures have the same number but different alphabetic suffixes.

Reference Numerals In Drawings

Figure 3A:
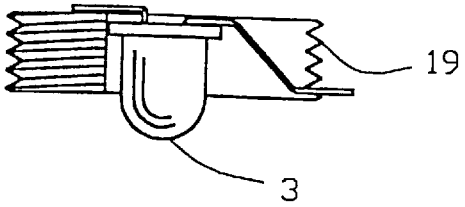
FIG. 3A shows a side view of an alternate threaded plug with LED for LED or lightbulb replacement and partial containment.
Figure 3B:
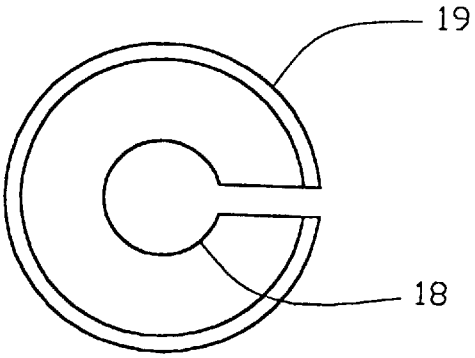
FIG. 3B shows a top view of the threaded plug of FIG. 3A.
Figure 4A:
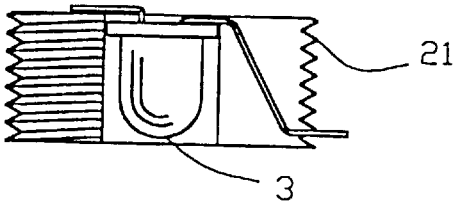
FIG. 4A shows a side view of an alternate threaded plug and LED with increased height for LED or light bulb replacement and full containment.
Figure 5A:
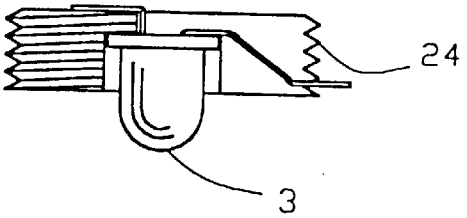
FIG. 5A shows a side view of an alternate threaded plug with LED for permanently sealing and partially containing the LED or light bulb.
Figure 4B:
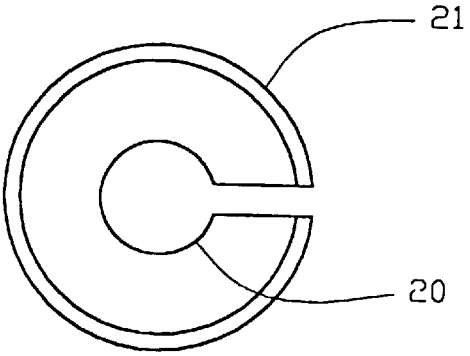
FIG. 4B shows a top view of the threaded plug of FIG. 4A.
Figure 5B:
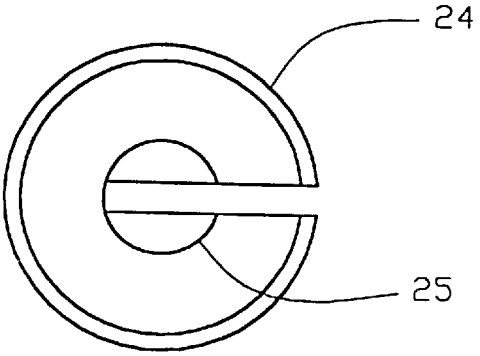
FIG. 5B shows a top view of the threaded plug of FIG. 5A.

| | |
|---|---|
| 1 ornament | 14 preferred threaded plug groove |
| 2 hole in ornament | 15 battery |
| 3 LED or light bulb | 16 base of LED or light bulb |
| 4 cathode lead of LED | 17 flat surface of ornament |
| 5 anode lead of LED | 18 alternate threaded plug groove and hole of FIG. 3B |
| 6 preferred threaded plug | 19 alternate threaded plug of FIG. 3A, 3B |
| 7 threaded cap | 20 alternate threaded plug groove and hole of FIG. 4B |
| 8 decorative covering | 21 alternate threaded plug of FIG. 4A, 4B |
| 9 decorative bell cap | 22 battery housing |
| 10 eye pin | 23 ornament housing |
| 11 jewelry glue | 24 alternate threaded plug of FIG. 5A, 5B |
| 12 tapered compression coil spring | 25 alternate threaded plug groove and hole of FIG. 5B |
| 13 groove for spring | |

SUMMARY OF INVENTION

Lighted jewelry ornaments contain a lighting device to be used with a variety of different light-transmissive ornaments for making illuminating earrings, necklaces, bracelets, pendants or decorative ornaments to be hung on clothing apparel, trees or chandeliers etc. They are composed of an ornament housing and a decorative threaded cap battery housing having an attachment device, such as an eyepin, as a point of attachment for a hanging support device such as an earring fish hook or necklace. The battery housing encloses a tapered compression coil spring and a battery that electrically connects to a light-emitting diode (LED) or light bulb which is contained within the ornament housing by a threaded plug. Adhered to an ornament is one of four threaded plugs, FIGS. 2A to 5B, which encircle the LED or light bulb and which screws into the decorative threaded cap. The ornaments are made of solid or hollow, clear or colored light-transmissive material such as plastic, glass, stone or other decorative material. The threaded plug is part of an ornament's mold and molding or is adhered to a pre-existing molded ornament. Two of the threaded plugs, FIGS. 3A, 3B and 4A, 4B allow for the replacement of the light-emitting diode or light bulb. Different types and colors of light-emitting diodes or light bulbs can be used. Enlargement of this invention allows for the use of multiple batteries or different types and sizes of batteries for brighter or longer illumination. Lighted jewelry ornaments light up when the battery housing and ornament housing are fully threaded together.

DESCRIPTION FIG. 1A to 5B

Figure 1A:
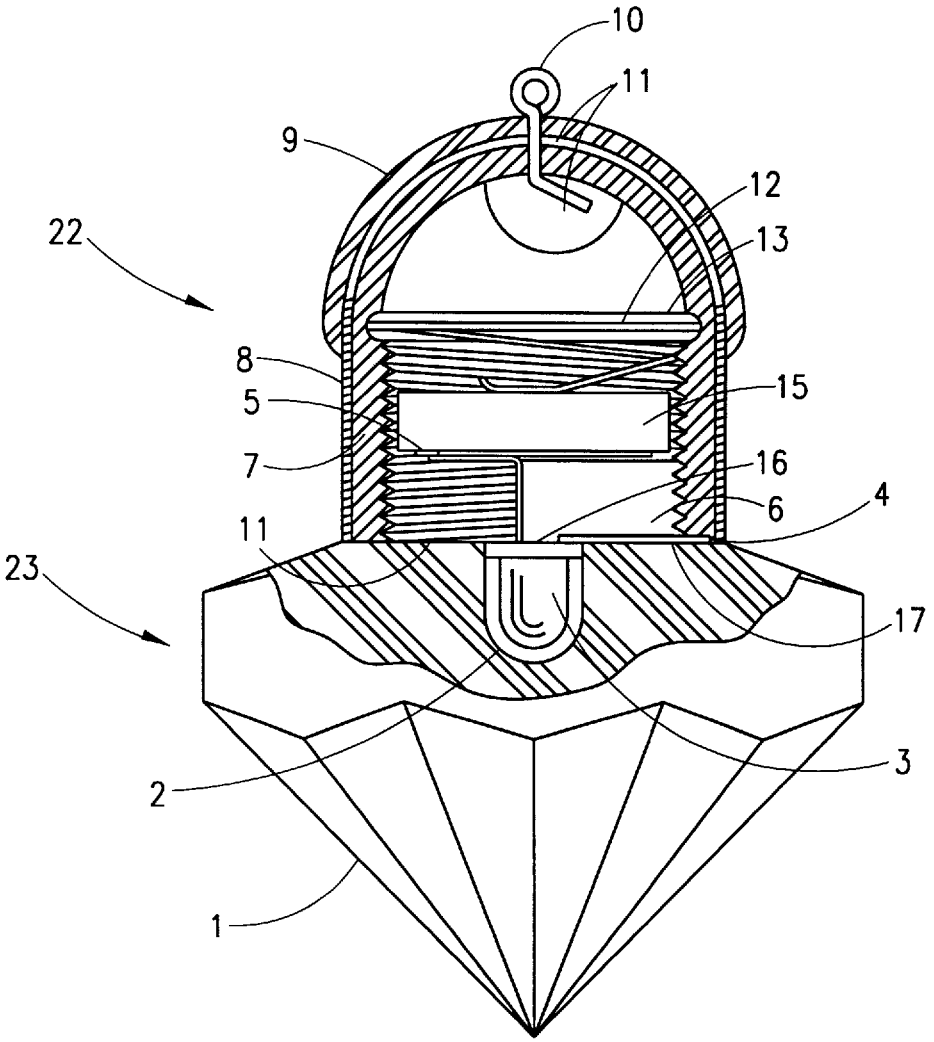
FIGS. 1A and 1B show a cross sectional view of a preferred embodiment of a lighted jewelry ornament with a preferred threaded plug that permanently seals and fully secures the LED or light bulb within the ornament.
Figure 1B:
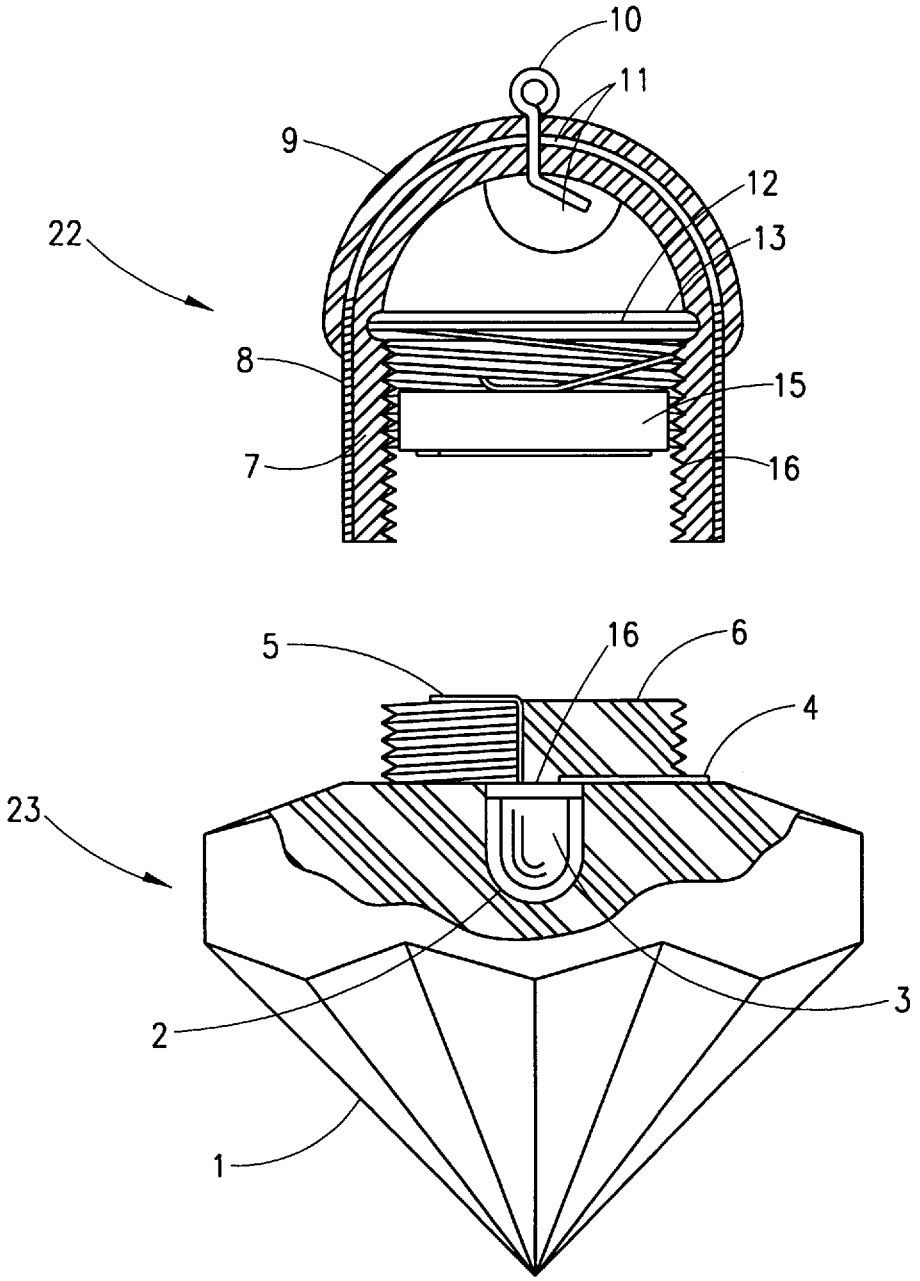

FIG. 1A and 1B show a cross sectional view of a preferred embodiment of a lighted jewelry ornament that contains two major portions, an ornament housing 23 and a battery housing 22. The ornament housing contains a threaded plug 6 with a groove 14, shown in FIG. 2B, that allows the passage of light emitting diode (LED) leads 4 and 5. The threaded plug is made of a rigid non-conductive material, such as acrylic plastic, which is adhered to a solid or hollow, clear or colored, light-transmissive acrylic crystal or decorative ornament 1 with acrylic adhesive, epoxy or compatible glue. The ornament has a flat surface 17 and a centrally located hole 2 to fit a matching sized LED 3. The threaded plug is glued flush with the flat surface 17 and the base 16 of the LED. The LED is permanently secured and sandwiched between the threaded plug and the ornament.

Figure 2A:
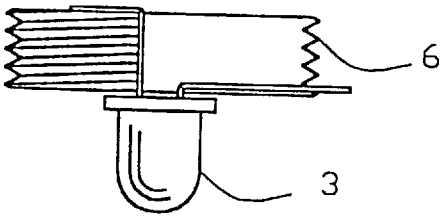
FIG. 2A shows a side view of the preferred threaded plug with LED.

The LED leads 4 and 5 which pass through the threaded plug groove 14 are cut and positioned as in FIG. 1 and 2A. Because electrical current only flows in one direction through mono-colored LEDs and blinking diodes, the cathode lead 4 of the LED is positioned in the groove of the threaded plug and the anode lead 5 is bent over and lays on top of the threaded plug and is cut short of the conductive threaded cap. The batteries negative terminal must be in contact with the anode lead 5. Light bulb leads may be positioned either way. Providing that a battery has an insulating jacket, the battery terminals may be reversed by turning the battery over for illuminating a bi-colored LED.

Figure 2B:
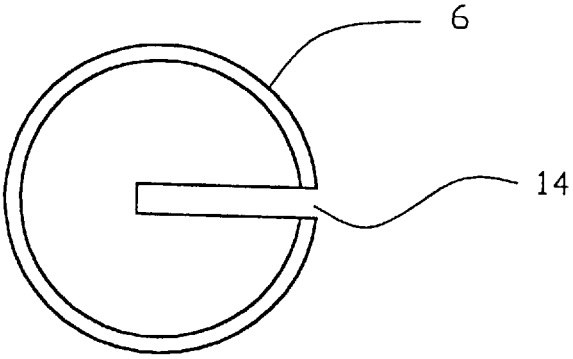
FIG. 2B shows a top view of the preferred threaded plug.

There are four threaded plug models to this invention: one threaded plug for permanently sealing in the LED or light bulb within the ornament FIGS. 2A, 2B ; one for replacing and partially containing the LED or light bulb FIGS. 3A, 3B ; one for replacing and fully containing the LED or light bulb FIGS. 4A, 4B ; and one for permanently sealing and partially containing the LED or light bulb FIGS. 5A, 5B. FIGS. 2A and 2B shows a threaded plug with a groove 14 cut all the way through the length of the threaded plug. FIGS. 3A, 3B and 4A, 4B provide a centrally located hole and groove cut all the way through the length of the threaded plug for LED or light bulb insertion after the threaded plug is adhered to the ornament. The LED or light bulb can also be removed. FIGS. 5A and 5B shows a threaded plug with a centrally located hole and groove but the centrally located hole is not cut all the way through the length of the threaded plug.

The battery housing portion contains a threaded cap 7 which is made of a conductive material, such as aluminum or brass. At the top of the threaded cap is a centrally located hole for an attachment device, such as an eye pin 10. The eye pin passes through a centrally located hole in both a decorative bell cap 9 and threaded cap and is secured to the threaded cap by bending the eye pin inside the threaded cap and jewelry glue 11. The bell cap is sandwiched between the eye pin and the threaded cap and further secured with jewelry glue placed between the bell cap and threaded cap. The eye pin serves as a point of attachment for a variety of hanging support devices used in jewelry manufacturing such as earring fish hooks and necklaces. The circular side of the threaded cap is decorated by adhering a decorative ribbon 8 with glue. A tapered compression coil spring 12 is secured inside the last groove 13 of the inside threads of the threaded cap. A battery 15 is pushed into the threaded cap against spring resistance with the positive end of the battery in contact with the spring. The ornament housing screws into the threaded cap enclosing the battery.

Operations-Fig. 1

The threaded cap 7 is completely screwed onto the threaded plug 6 making contact with the LED cathode lead 4 allowing the electric current to flow from the negative end of the battery 15 making contact with and through the anode lead 5 of the LED 3. Current proceeds through the LED 3, lighting it, and out the cathode lead 4 making contact with the threaded cap 7, and then through the threaded cap 7 making contact with the tapered compression coil spring 12, and then through the tapered compression coil spring 12 making contact with the positive end of the battery 1 5 thus completing the circuit. The tension of the tapered compression coil spring allows for solid contact between spring and threaded cap, spring and battery, and battery and anode lead 5 of the LED securing constant current flow for a steady illuminated light. The spring tension permits easy removal of the battery which slides in and out of the threaded cap against spring resistance.

The spring tension adds friction, in addition to having snug threads, between the threaded cap and threaded plug preventing unintentional screwing and unscrewing, yet permits intentional screwing and unscrewing of the threaded cap. Partially unscrewing the threaded cap about a ¼ of a turn will disconnect the LED cathode lead 4 to the threaded cap, thus shutting off the light to conserve battery life when the light is not desired. Turning the battery over, providing that it has an insulating jacket to prevent shorting against the threaded cap, will also turn off the light when a mono-colored or blinking diode is used.

Conclusion, Ramifications, and Scope

This invention can be adapted to any size LED or light bulb that allows sufficient surface contact for gluing the threaded plug to the ornament.

The threaded cap portion can be made shorter, longer, narrower or wider to accommodate any size battery or multiple batteries which would be electrically matched with their respective LED or light bulb for brighter or longer illumination. The threaded plug would also be adapted in size to accommodate any size changes of the threaded cap.

The batteries and tapered compression coil spring are replaceable in addition to the lights used with the threaded plugs in FIGS. 3A, 3B and 4A, 4B.

Lighted Jewelry Ornaments allow for the use of a pre-existing molded light transmissive solid or hollow ornament, that is produced and sold on the market, to be adapted with a light source by simply adhering one of the threaded plugs to a sufficiently sized flat surface of the ornament. The ornaments can also be manufactured with a mold containing one of the threaded plug models illustrated in FIGS. 2A–5B as a completed ornament housing. Lastly, the ornaments may be of any displayed configuration.

From the foregoing description it is evident that this is a new and improved invention, namely, Lighted Jewelry Ornaments. While this invention has been shown and described, herein, in what is conceived to be the most practical and preferred embodiment, it is recognized that departures may be made, therefrom, within the scope of the invention, which is therefore not to be limited to details disclosed, herein, but is to be afforded the full scope of the claims so as to embrace any and all equivalent apparatus and articles.

I claim:

1. A lighted ornament apparatus comprising:

a light-transmissive ornament housing having an attachment surface;

a threaded plug attached to said ornament at said attachment surface, said threaded plug having a light means attached thereto for internally lighting said ornament;

a threaded cover for threadedly engaging said threaded plug and securing said threaded cover to said ornament; and battery means, within said threaded cover, for powering said light means and internally lighting said ornament, whereby said battery means powers said light means when said threaded cover threadedly engages said threaded plug.

2. The lighted ornament apparatus according to claim 1, wherein said light means is a light bulb.

3. The lighted ornament apparatus according to claim 1, wherein said light means is a light-emitting diode.

4. The lighted ornament apparatus according to claim 1, wherein said light means extends from said threaded plug into said ornament.

5. The lighted ornament apparatus according to claim 4, wherein said light means is secured to an outer surface of said threaded plug.

6. The lighted ornament apparatus according to claim 1, wherein said threaded plug has an aperture therethrough, said light means being attached to said threaded plug within said aperture, whereby said light means may be interchanged.

7. The lighted ornament apparatus according to claim 1, wherein said battery means powers said light means after said threaded cover threadedly engages said threaded plug past a given threaded engagement position.

8. The lighted ornament apparatus according to claim 7, wherein said given threaded engagement position is about one-fourth of a rotation of said threaded cover about said threaded plug from a fully threaded position.

9. The lighted ornament apparatus according to claim 1, further comprising:

spring means, within said threaded cover, for contacting with and applying a compressive force against said battery means.

10. The lighted ornament apparatus according to claim 1, wherein an electrical circuit is formed from a first end of said battery means to said light means to said threaded cover to a spring means within said threaded cover to a second end of said battery means, said threaded cover and said spring means being made of a conductive material and said threaded plug being made of a non-conductive material.

11. The lighted ornament apparatus according to claim 10, wherein said threaded plug has an aperture therethrough, a first lead connecting said battery means to said light means through said aperture and a second lead connecting said light means to said threaded cover through said aperture.

12. The lighted ornament apparatus according to claim 11, wherein said threaded plug is a threaded cylinder, said aperture being a radial groove therethrough.

13. The lighted ornament apparatus according to claim 12, wherein said aperture further comprises a light means receiving portion therein for receiving said light means.

14. The lighted ornament apparatus according to claim 1, further comprising:

hanging support means, attached to said threaded cover, for providing a hanging support for said lighted ornament apparatus.

15. The lighted ornament apparatus according to claim 1, wherein said battery means comprises an enclosure within said threaded cover for a plurality of batteries therein.

16. The lighted ornament apparatus according to claim 1, wherein said battery means comprises an enclosure within said threaded cover adapted for batteries having a plurality of sizes.

17. The lighted ornament apparatus according to claim 1, wherein said threaded cover has a decorative exterior.

18. The lighted ornament apparatus according to claim 1, wherein said lighted ornament is selected from the group consisting of earrings, pendants, necklaces, bracelets and decorative hangings.

19. A lighted ornament apparatus comprising:

a light-transmissive ornament housing having a threaded plug member extending therefrom;

light means substantially within said ornament for internally lighting said ornament;

a threaded cover for threadedly engaging said threaded plug member and securing said threaded cover to said ornament; and battery means, within said threaded cover, for powering said light means and internally lighting said ornament, whereby said battery means powers said light means when said threaded cover threadedly engages said threaded plug member.

20. The lighted ornament apparatus according to claim 19, wherein said light means is a light bulb.

21. The lighted ornament apparatus according to claim 19, wherein said light means is a light-emitting diode.

22. The lighted ornament apparatus according to claim 19, wherein said threaded plug member has an aperture therethrough, said light means being attached to said threaded plug member within said aperture, whereby said light means may be interchanged.

23. The lighted ornament apparatus according to claim 19, wherein said battery means powers said light means after said threaded cover threadedly engages said threaded plug member past a given threaded engagement position.

24. The lighted ornament apparatus according to claim 23, wherein said given threaded engagement position is about one-fourth of a rotation of said threaded cover about said threaded plug member from a fully threaded position.

25. The lighted ornament apparatus according to claim 19, further comprising:

spring means, within said threaded cover, for contacting with and applying a compressive force against said battery means.

26. The lighted ornament apparatus according to claim 19, wherein an electrical circuit is formed from a first end of said battery means to said light means to said threaded cover to a spring means within said threaded cover to a second end of said battery means, said threaded cover and said spring means being made of a conductive material and said threaded plug member being made of a non-conductive material.

27. The lighted ornament apparatus according to claim 26, wherein said threaded plug member has an aperture therethrough, a first lead connecting said battery means to said light means through said aperture and a second lead connecting said light means to said threaded cover through said aperture.

28. The lighted ornament apparatus according to claim 27, wherein said threaded plug member is a threaded cylinder, said aperture being a radial groove therethrough.

29. The lighted ornament apparatus according to claim 28, wherein said aperture further comprises a light means receiving portion therein for receiving said light means.

30. The lighted ornament apparatus according to claim 19, further comprising:

hanging support means, attached to said threaded cover, for providing a hanging support for said lighted jewelry ornament apparatus.

31. The lighted ornament apparatus according to claim 19, wherein said battery means comprises an enclosure within said threaded cover for a plurality of batteries therein.

32. The lighted ornament apparatus according to claim 19, wherein said battery means comprises an enclosure within said threaded cover adapted for batteries having a plurality of sizes.

33. The lighted ornament apparatus according to claim 19, wherein said threaded cover has a decorative exterior.

34. The lighted ornament apparatus according to claim 19, wherein said lighted ornament is selected for the group consisting of earrings, pendants, necklaces, bracelets and decorative hangings.

* * * * *